US009594327B2

(12) United States Patent
Masuda et al.

(10) Patent No.: US 9,594,327 B2
(45) Date of Patent: Mar. 14, 2017

(54) OPTICAL WRITING DEVICE AND IMAGE FORMING APPARATUS

(71) Applicant: KONICA MINOLTA INC., Chiyoda-ku, Tokyo (JP)

(72) Inventors: Satoshi Masuda, Neyagawa (JP); Makoto Obayashi, Toyokawa (JP); Yoshikazu Watanabe, Toyohashi (JP); Masayuki Iijima, Okazaki (JP); So Yano, Ibaraki (JP); Takaki Uemura, Seto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/699,189

(22) Filed: Apr. 29, 2015

(65) Prior Publication Data

US 2015/0317953 A1 Nov. 5, 2015

(30) Foreign Application Priority Data

May 1, 2014 (JP) ..... 2014-094571

(51) Int. Cl.
*G03G 15/04* (2006.01)
*G09G 5/18* (2006.01)
(Continued)

(52) U.S. Cl.
CPC ..... *G03G 15/04054* (2013.01); *G09G 3/3283* (2013.01); *G09G 5/18* (2013.01); *G09G 2300/0426* (2013.01)

(58) Field of Classification Search
CPC ..... G09G 2300/0426; G09G 5/18; G09G 3/3283; G03G 15/04054
See application file for complete search history.

(56) References Cited

U.S. PATENT DOCUMENTS 6,121,994 A 9/2000 Kuribayashi et al.
2005/0146593 A1* 7/2005 Yamazaki ..... B41J 2/45 347/130
(Continued)

FOREIGN PATENT DOCUMENTS

JP 11-198433 A 7/1999
JP 2005-144685 A 6/2005
(Continued)

OTHER PUBLICATIONS

Office Action issued on Aug. 30, 2016, by the Japanese Patent Office, in corresponding Japanese Patent Application No. 2014-094571, and an English language translation of the Office Action (8 pages).

*Primary Examiner* — Charles Hicks
(74) *Attorney, Agent, or Firm* — Buchanan Ingersoll & Rooney PC

(57) ABSTRACT

An optical writing device includes a plurality of current driven light emitting elements, first and second power source lines, a designation circuit that outputs a designation potential, first driving circuits provided for each of the light emitting elements to supply driving current to the corresponding light emitting element, second driving circuits provided for each of the light emitting elements to supply driving current to the corresponding light emitting element, and a switching control unit that alternately switches respective states of the first and second driving circuits between a state where one of the first and second driving circuits receives the designation potential while the other driving circuit supplies the driving current, and a state where the other driving circuit receives the designation potential while the one driving circuit supplies the driving current.

16 Claims, 10 Drawing Sheets

(51) Int. Cl.
*G09G 3/3283* (2016.01)
*G09G 3/32* (2016.01)

(56) References Cited

U.S. PATENT DOCUMENTS

| | | | |
|---|---|---|---|
| 2007/0001940 | A1 | 1/2007 | Jo |
| 2010/0141646 | A1 | 6/2010 | Tanabe |

FOREIGN PATENT DOCUMENTS

| | | | |
|---|---|---|---|
| JP | 2005-144686 | A | 6/2005 |
| JP | 2005-144687 | A | 6/2005 |
| JP | 2006-011401 | A | 1/2006 |
| JP | 2007-011177 | A | 1/2007 |
| JP | 2010-076184 | A | 4/2010 |
| WO | 2009/013806 | A1 | 1/2009 |

* cited by examiner mTH LINE (m+1)TH LINE

OPTICAL WRITING DEVICE AND IMAGE FORMING APPARATUS

The entire disclosure of Japanese Patent Application No. 2014-094571 filed on May 1, 2014 including description, claims, drawings, and abstract are incorporated herein by reference in its entirety.

BACKGROUND OF THE INVENTION

Field of the Invention

The present invention relates to an optical writing device and an image forming apparatus, and particularly to a technology for preventing non-uniformity of light intensity of an optical writing device which uses an organic LED.

Description of the Related Art

In recent years, an optical writing device (PH: Print Head) including organic LEDs (OLEDs: Organic Light Emitting Diodes) has been proposed as a component equipped on an image forming apparatus with an aim of miniaturization and cost reduction of the image forming apparatus. OLEDs are disposed on a TFT (Thin Film Transistor) substrate and arranged in lines in a horizontal scanning direction, and electrically connected in parallel via power source wiring similarly arranged in the horizontal scanning direction (FIG. 10).

An OLED is called an organic EL (Organic Electro-Luminescence) element as well, and provided as a current driven light emitting element. When driving current is supplied to an OLED via power source wiring, a voltage drop occurs along the power source wiring due to wiring resistance.

On the other hand, a driving circuit which generates driving current for an OLED is provided for each OLED at a position adjacent to the corresponding OLED, and generates driving current in reference to an electric potential at a junction point between the driving circuit and the power source wiring. Accordingly, the voltage drop at the power source wiring produces a drop of the reference potential, in which condition the amount of driving current to be supplied to the OLED is variable. In this case, the light emission luminance becomes variable, and non-uniformity of images may be caused (FIGS. 11A and 11B).

For overcoming this problem, reduction of impedance of power source wiring has been proposed, for example (JP 2005-144685 A, JP 2005-144686 A, JP 2005-144687 A, and JP 2010-076184 A). According to this method, the voltage drop produced by driving current is avoidable, wherefore the non-uniformity of images can decrease.

According to the foregoing conventional technology, power source wiring is further formed on sealing glass provided for sealing the TFT substrate, and the power source wiring on the TFT substrate and the power source wiring on the sealing glass are electrically connected by connecting parts at respective power supply points of the driving circuit, for the purpose of reduction of impedance of the power source wiring. In this case, there is a problem that the unit cost rises. Moreover, the auxiliary power source wiring thus formed is thin-film wiring, wherefore reduction of impedance of the power source wiring is limited.

According to another conventional technology, one line cycle is divided into a sample period and a hold period. During the sample period, OLEDs are turned off, and a luminance signal output from a DAC (Digital to Analogue Converter) circuit is temporarily held in a sample hold circuit (hereinafter referred to as "S/H circuit") provided for each OLED. During the hold period, driving current in correspondence with the luminance signal held in the S/H circuit is supplied to each OLED to allow light emission therefrom.

According to this structure, no driving current flows during the sample period, in which condition no voltage drop occurs. Accordingly, the luminance signal is appropriately sampled, wherefore non-uniformity of luminance caused by a voltage drop is avoidable.

However, while a method so-called rolling driving turns off an OLED only when the luminance signal is input to the corresponding S/H circuit, this conventional technology turns off OLEDs throughout the sample period in which luminance signals are sequentially input to a number of S/H circuits, and only turns on the OLEDs during the hold period. In this case, light emission duty corresponding to a proportion of a light emission period in a horizontal scanning period (Hsync) lowers, wherefore the light emission period becomes short.

When the light emission amount from the OLEDs is raised by increasing the amount of driving current supplied to the OLEDs so as to obtain sufficient exposure during the short light emission period, the life of the OLEDs may decrease.

SUMMARY OF THE INVENTION

The present invention has been developed to solve the aforementioned problems. It is an object of the present invention to provide an optical writing device and an image forming apparatus, capable of improving image quality and prolonging lives of the optical writing device and the image forming apparatus, by preventing non-uniformity of light intensity of OLEDs, and increasing light emission duty.

To achieve the abovementioned object, according to an aspect, an optical writing device that exposes a photosensitive body to form an electrostatic latent image line by line for each horizontal scanning period, reflecting one aspect of the present invention, comprises: a plurality of current driven light emitting elements arranged in lines; first and second power source lines extending along the plurality of light emitting elements, and connected with a constant voltage source; a designation circuit that outputs a designation potential designating a light emission amount for each of the light emitting elements; first driving circuits provided for each of the light emitting elements, each of the first driving circuits including a first holding circuit that receives and holds the designation potential output from the designation circuit, and connected with the first power source line to supply driving current to the corresponding light emitting element in accordance with a potential difference between a potential at a junction point with the first power source line and the designation potential held by the first holding circuit; second driving circuits provided for each of the light emitting elements, each of the second driving circuits including a second holding circuit that receives and holds the designation potential output from the designation circuit, and connected with the second power source line to supply driving current to the corresponding light emitting element in accordance with a potential difference between a potential at a junction point with the second power source line and the designation potential held by the second holding circuit; and a switching control unit that controls the first and second driving circuits provided for the same light emitting element so as to alternately switch respective states of the first and second driving circuits between a state where one of the first and second driving circuits receives the designation potential while the other driving circuit supplies the driving current, and a state where the other driving circuit receives the designation potential while the one driving circuit supplies the driving current, for each of the horizontal scanning periods.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an optical writing device and an image forming apparatus according to an embodiment of the present invention will be described with reference to the drawings. However, the scope of the invention is not limited to the illustrated examples.

[1] Configuration of Image Forming Apparatus

Initially, a configuration of the image forming apparatus according to this embodiment is described.

[1-1] Configuration of Image Forming Apparatus

The configuration of the image forming apparatus according to this embodiment is now described.

Figure 1:
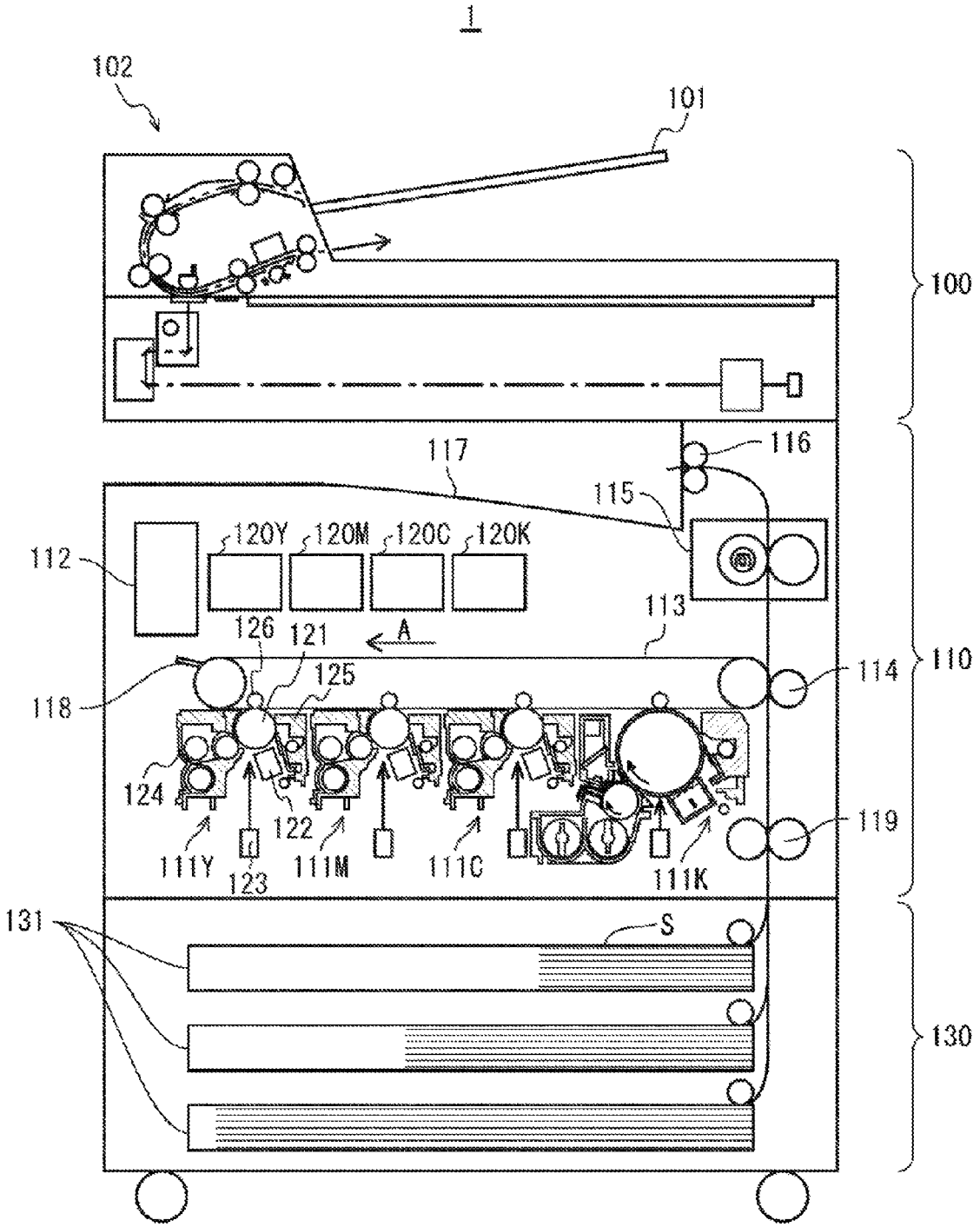
FIG. 1 is a view illustrating a main configuration of an image forming apparatus according to an embodiment of the present invention.

FIG. 1 is a view illustrating a main configuration of the image forming apparatus according to this embodiment. As illustrated in FIG. 1, an image forming apparatus 1 is a so-called tandem color multi-function peripheral (MFP), and includes a document reading unit 100, an image forming unit 110, and a feeding unit 130. The document reading unit 100 optically reads a document placed on a document tray 101 and creates image data of the document, while sending the document by using an automatic document feeder (ADF) 102. The image data thus obtained is stored in a control unit 112 (described later).

The image forming unit 110 includes imaging units 111Y through 111K, the control unit 112, an intermediate transfer belt 113, a pair of secondary transfer rollers 114, a fixing device 115, a pair of discharge rollers 116, a discharge tray 117, a cleaning blade 118, and a pair of timing rollers 119. Toner cartridges 120Y through 120K are attached to the image forming unit 110 to supply toner in colors of Y (yellow), M (magenta), C (cyan), and K (black), respectively.

The imaging units 111Y through 111K receive supply of toner from the corresponding toner cartridges 120Y through 120K, and form toner images in respective colors of Y, M, C, and K under the control of the control unit 112. For example, the imaging unit 111Y includes a photosensitive drum 121, a charging device 122, an optical writing device 123, a developing device 124, and a cleaning device 125. The charging device 122 uniformly charges an outer circumferential surface of the photosensitive drum 121 under the control of the control unit 112.

The control unit 112 generates a digital luminance signal to allow light emission from the optical writing device 123 based on printing image data contained in a received job. The control unit 112 generates this digital luminance signal by using an ASIC (Application Specific Integrated Circuit, hereinafter referred to as "luminance signal output unit") contained in the control unit 112. The optical writing device 123 includes light emitting elements arranged in lines in the horizontal scanning direction, as will be described later. The optical writing device 123 executes optical writing to the outer circumferential surface of the photosensitive drum 121 by utilizing light emitted from the respective light emitting elements in response to the digital luminance signal generated from the control unit 112, and forms an electrostatic latent image.

The developing device 124 supplies toner to the outer circumferential surface of the photosensitive drum 121 to develop the electrostatic latent image (visualize the image). Primary transfer voltage is applied to the primary transfer roller 126 so that a toner image carried on the outer circumferential surface of the photosensitive drum 121 can be electrostatically transferred to the intermediate transfer belt 113 by electrostatic attachment (primary transfer). After the primary transfer, the cleaning device 125 scrapes residual toner remaining on the outer circumferential surface of the photosensitive drum 121 off the surface by using a cleaning blade, and illuminates the outer circumferential surface of the photosensitive drum 121 by using a discharging lamp to remove charges from the surface.

The imaging units 111M through 111K form toner images in colors of M, C, and K, respectively, in manners similar to the foregoing method. These toner images are sequentially transferred to the intermediate transfer belt 113 by the primary transfer such that the respective toner images are overlapped with each other and forma color toner image on the intermediate transfer belt 113. The intermediate transfer belt 113 is an endless rotating body which rotates in a direction indicated by an arrow A. The intermediate transfer belt 113 sends the toner image after the primary transfer toward the pair of secondary transfer rollers 114.

The feeding unit 130 includes feeding cassettes 131, each of which stores recording sheets S in corresponding sheet size. The feeding unit 130 supplies the recording sheets S sheet by sheet to the image forming unit 110. The recording sheet S supplied from the feeding unit 130 is conveyed in parallel with the running of the toner image on the intermediate transfer belt 113, and passes through the pair of timing rollers 119 to reach the pair of secondary transfer rollers 114.

The pair of timing rollers 119 sends the recording sheet S such that the recording sheet S and the toner image can reach the pair of secondary transfer rollers 114 at the same time.

The pair of secondary transfer rollers 114 is constituted of a pair of rollers to which secondary transfer voltage is applied. The pair of secondary transfer rollers 114 is pressed against each other to form a secondary transfer nip portion. The toner image on the intermediate transfer belt 113 is electrostatically transferred to the recording sheet S (secondary transfer) at this transfer nip portion. The recording sheet S to which the toner image has been transferred is sent to the fixing device 115. Residual toner remaining on the intermediate transfer belt 113 after the secondary transfer is further conveyed in the direction of the arrow A, and scraped by the cleaning blade 118 to be discarded.

The fixing device 115 fixes the toner image to the recording sheet S by heating and fusing the toner image. The recording sheet S to which the toner image has been fixed by fusing is discharged to the discharge tray 117 by the pair of discharge rollers 116.

The control unit 112 controls the foregoing processes and other operation of the image forming apparatus 1, including operation of a not-shown operation panel. The control unit 112 transmits and receives image data to and from other devices such as a personal computer (PC), and receives printing jobs. The control unit 112 includes a facsimile modem to transmit and receive image data to and from other facsimile machines via facsimile lines.

Instead of the configuration discussed herein, a transfer charger or a transfer belt may be employed in transferring toner images in place of the transfer rollers. In addition, in removing residual toner from the intermediate transfer belt 113, a cleaning brush or a cleaning roller may be employed in place of the cleaning blade 118.

[2] Configuration of Optical Writing Device 123

A configuration of the optical writing device 123 is hereinafter described.

Figure 2:
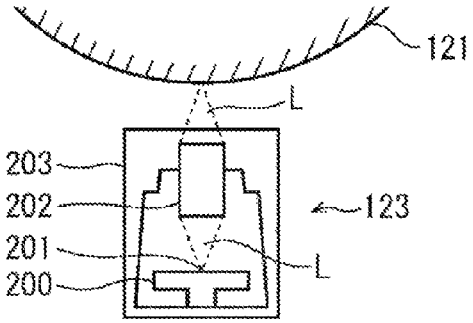
FIG. 2 is a cross-sectional view illustrating optical writing operation executed by an optical writing device 123.

FIG. 2 is a cross-sectional view illustrating optical writing operation performed by the optical writing device 123. As illustrated in FIG. 2, the optical writing device 123 includes an OLED panel 200 and a rod lens array (SLA: Selfoc Lens Array) 202, both components of which are housed in a holder 203. OLEDs 201 corresponding to a number of light emission dots are mounted on the OLED panel 200 and arranged in lines in the horizontal scanning direction. Each of the OLEDs 201 emits optical beams L, while the rod lens array 202 converges the optical beams L on the outer circumferential surface of the photosensitive drum 121.

Figure 3:
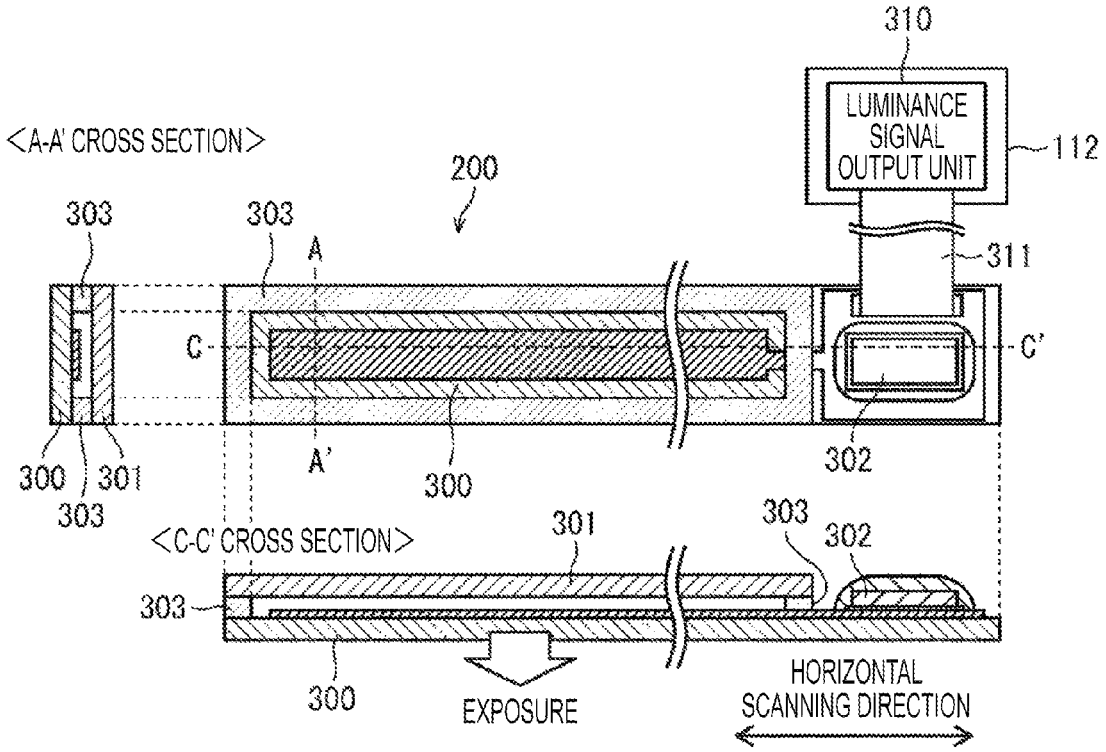
FIG. 3 is a schematic plan view of an OLED panel 200, accompanied with a cross-sectional view taken along a line A-A', and a cross-sectional view taken along a line C-C'.

FIG. 3 is a schematic plan view of the OLED panel 200, accompanied with a cross-sectional view taken along a line A-A', and a cross-sectional view taken along a line C-C'. A schematic plan view part in FIG. 3 shows the OLED panel 200 from which a sealing plate (described later) is removed.

As illustrated in FIG. 3, the OLED panel 200 includes a TFT substrate 300, a sealing plate 301, a source IC 302, and others. A number of OLEDs are disposed on the TFT substrate 300 and arranged in lines in the horizontal scanning direction. The TFT substrate 300 has a substrate surface on which the OLEDs are arranged. This surface is provided as a sealing area to which the sealing plate 301 is attached with spacer frame bodies 303 interposed between the sealing area and the sealing plate 301.

This structure produces a sealed condition of the sealing area, into which dry nitrogen or the like is charged to avoid contact between the sealing area and the outside air. A moisture absorbent may be further sealed into the sealing area for absorbing moisture. The sealing plate 301 may be made of sealing glass, for example, or material other than glass.

The source IC 302 is mounted on the TFT substrate 300 in an area out of the sealing area. A luminance signal output unit 310 of the control unit 112 inputs a digital luminance signal to the source IC 302 via a flexible wire 311. The source IC 302 converts the digital luminance signal into an analog luminance signal (hereinafter abbreviated as "luminance signal"), and inputs the converted signal to driving circuits provided for each of the OLEDs. The driving circuits generate driving current for the OLEDs in accordance with the luminance signal. According to this embodiment, the luminance signal is a voltage signal.

According to this embodiment, 15,000 OLEDs are arranged in lines on the TFT substrate 300, and divided into 150 light emission blocks each of which contains 100 OLEDs.

Figure 4:
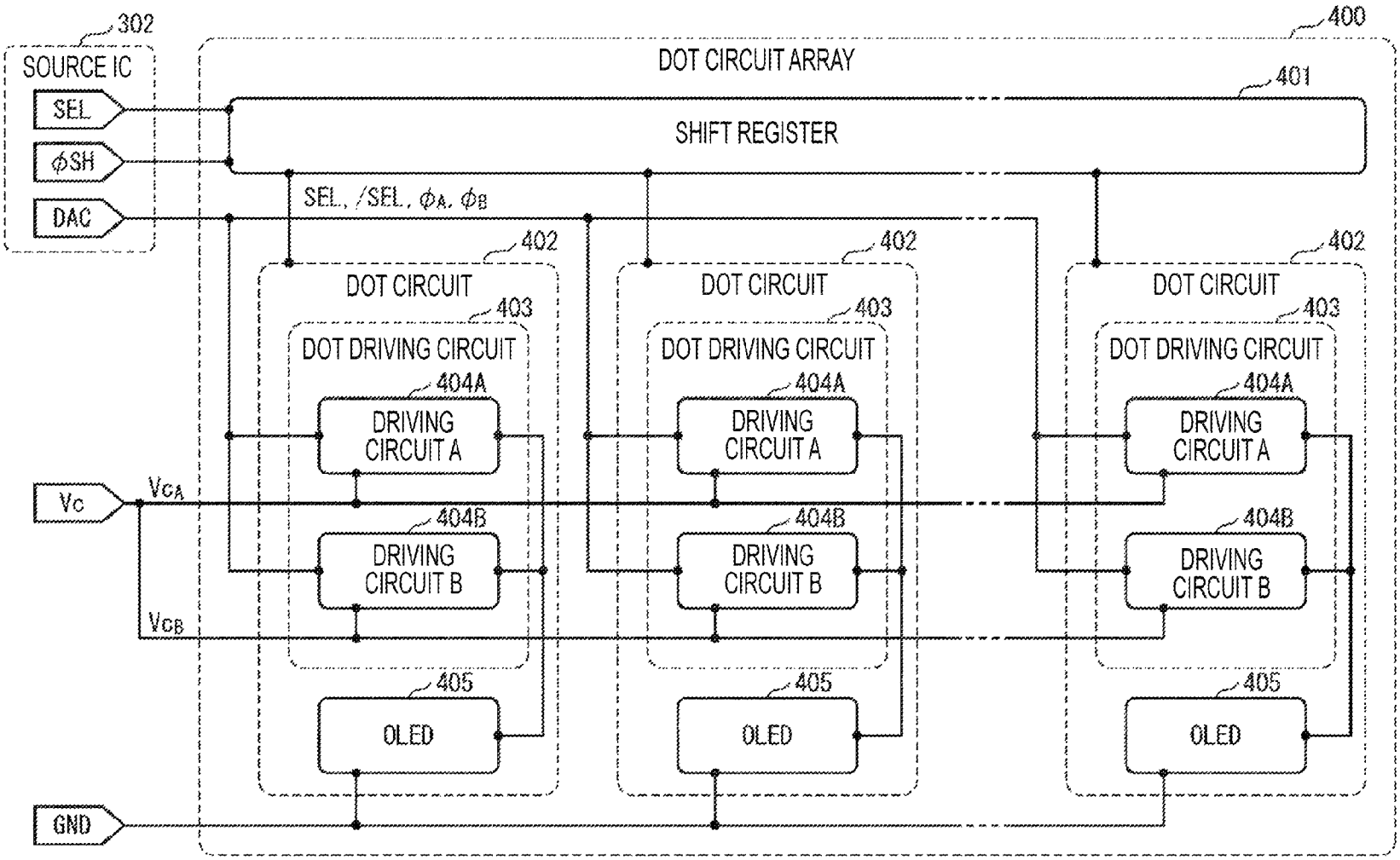
FIG. 4 is a block diagram illustrating a main circuit configuration on a TFT substrate 300.

FIG. 4 is a block diagram illustrating a main circuit configuration on the TFT substrate 300. As illustrated in FIG. 4, a dot circuit array 400 is formed on the TFT substrate 300. The dot circuit array 400 includes, for each light emission block, a shift register 401, and dot circuits 402 provided for each of OLEDs 405, and receives input of control signals from an SEL circuit, a ϕSH circuit, and a DAC circuit contained in the source IC 302.

Figure 5:
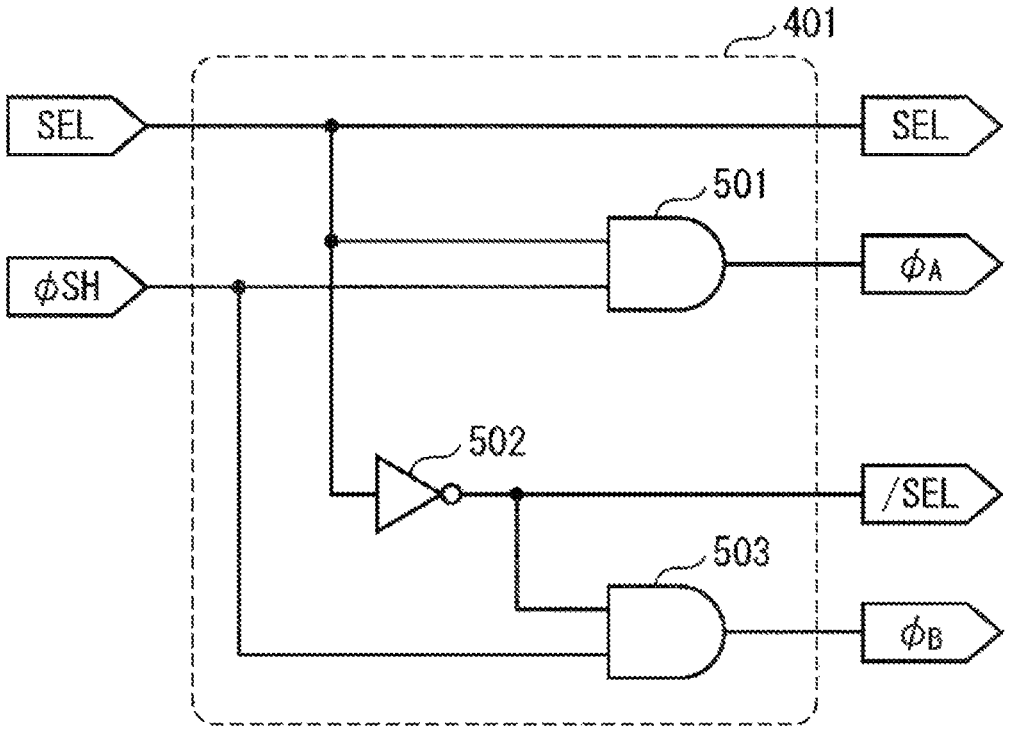
FIG. 5 is a view illustrating a main configuration of a shift register 401.

The shift register 401 provided for each of the light emission blocks sequentially designates a dot circuit to which a luminance signal is to be written. The shift register 401 also includes a logic circuit for controlling operation of the corresponding dot circuits 402. FIG. 5 illustrates a main configuration of the shift register 401. The shift register 401, having received input of an SEL signal and a ϕSH signal from the SEL circuit and the ϕSH circuit of the source IC, produces a /SEL signal corresponding to an inverse signal of the SEL signal at a NOT element 502.

The shift register 401 further produces a ϕA signal at an OR element 501 based on the SEL signal and the ϕSH signal, and produces a ϕB signal at an OR element 503 based on the /SEL signal and the ϕSH signal. The SEL signal and the /SEL signal are used in selecting a power source line through which driving current is supplied to the corresponding OLED 405, as will be discussed later. The ϕA signal and the ϕB signal are used in determining whether or not the luminance signal is to be written.

Each of the dot circuits 402 includes the OLED 405 and a dot driving circuit 403. The dot driving circuit 403 is constituted of driving circuits 404A and 404B of dual systems A and B. The driving circuits 404A and 404B receive power supply via power source lines VcA and VcB of the dual systems A and B, respectively, as lines extending from a constant voltage source Vc. The power source lines VcA and VcB are branched from each other in the vicinity of the DAC circuit (source IC 302) outside the dot circuit array 400, and wired after the branch to the driving circuits 404A and 404B, respectively, with no junction between the power source lines VcA and VcB.

Driving current of an amount corresponding to the luminance signal received from the DAC circuit is supplied to the OLED 405 via the driving circuit 404A or 404B designated based on the SEL signal and the /SEL signal.

According to this embodiment, the TFT substrate 300 is formed in the following procedures. Initially, the dot circuit array 400 not including the OLEDs 405 is formed on a glass substrate. Then, the OLEDs 405 are formed. Subsequently, the source IC 302 is mounted to complete the TFT substrate 300.

[3] Configuration of Driving Circuits 404

A configuration of the driving circuits 404 is hereinafter described. The driving circuits 404A and 404B of the A and B systems have a common configuration. Accordingly, in the following description, signs "A" and "B" are not given to the reference numerals of the driving circuits 404A and 404B.

Figure 6:
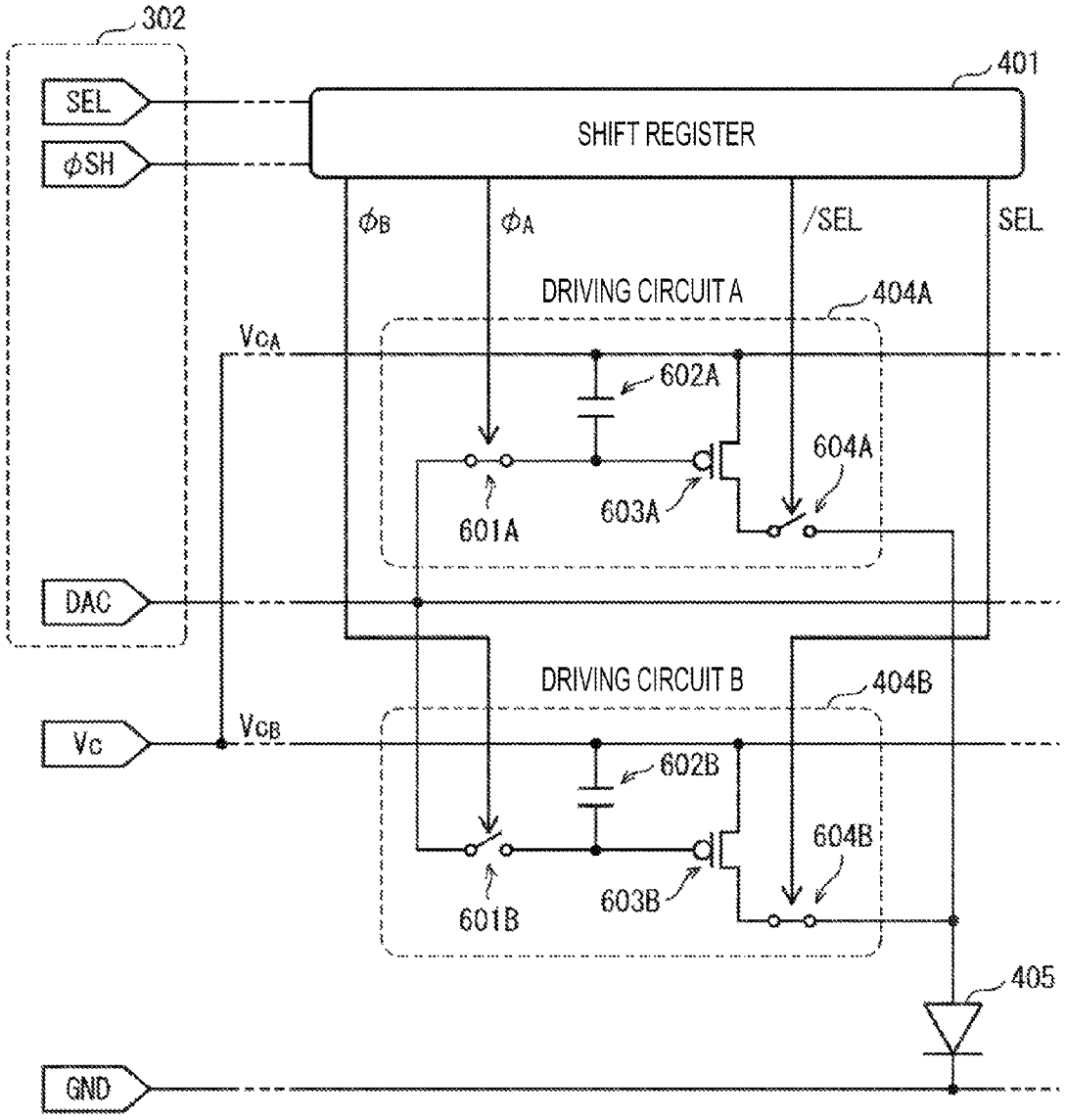
FIG. 6 is a circuit diagram illustrating a main configuration of a driving circuit 404.

FIG. 6 is a circuit diagram illustrating a main configuration of the driving circuits 404. As illustrated in FIG. 6, each of the driving circuits 404 includes selector switches 601 and 604, a capacitor 602, and a TFT 603. According to this embodiment, each of the selector switches 601 and 604 is a TFT.

The capacitor 602 and the selector switch 601 function as an S/H circuit unit, and hold a potential difference between the luminance signal output from the DAC circuit, and the constant voltage source Vc. The respective selector switches 601 disposed on wires extending from a corresponding signal line to the capacitors 602 are switched in accordance with the control signals ϕA and ϕB received from the shift register 401, so that the luminance signal is input only to the selected capacitor 602 and held therein.

According to this embodiment, the signal line extending from the DAC circuit to the driving circuits 404 is provided as a common line for the A and B systems. However, the signal line from the DAC circuit may be separately provided for each of the A and B systems.

The TFT 603 supplies, to the OLED 405, driving current corresponding to the luminance signal held in the capacitor 602, in response to the luminance signal applied between a source and a drain of the TFT 603.

The selector switch 604 is disposed between a drain terminal of the TFT 603 and the OLED 405. The selector switch 604 functions as a driving current control unit which supplies driving current to the OLED 405 only from the driving circuit 404 of the system A or B2 selected by the shift register 401.

When the selector switch 604 is disposed on the circuitry in the range from the power source line Vc to the TFT 603, gate voltage Vg of the TFT 603 is variable in accordance with variations of conduction-state characteristics of the selector switch 604. In this case, the accuracy of the driving current amount to be supplied may decrease.

Moreover, in manufacturing the OLED panel 200, OLEDs need to be formed on the upper part of TFTs previously formed on the glass substrate. Accordingly, when the selector switch 604 is disposed on the cathode side of the OLED 405, the OLED 405 comes to the position of the circuitry in the range from the TFT 603 to the selector switch 604.

In this case, the selector switch 604 needs to be further formed on the upper part of the OLED 405, for example, after the OLED 405 is formed on the upper part of the TFT 603. Accordingly, a connection step is additionally required for connecting the OLED 405 and the selector switch 604, in which case design and manufacture become difficult.

On the other hand, when the selector switch 604 is disposed on the circuitry in the range from the TFT 603 to the OLED 405 as in this embodiment, the following advantages are offered:

(a) reduction of variations of the driving current amount resulting from variations of the conduction-state characteristics of the selector switch 604; and (b) easy formation of the circuitry.

[4] Operation of Optical Writing Device 123

Operation of the optical writing device 123 is hereinafter described. Every light emission block operates in a similar manner, wherefore operation of one of the light emission blocks is only discussed herein.

Figure 7:
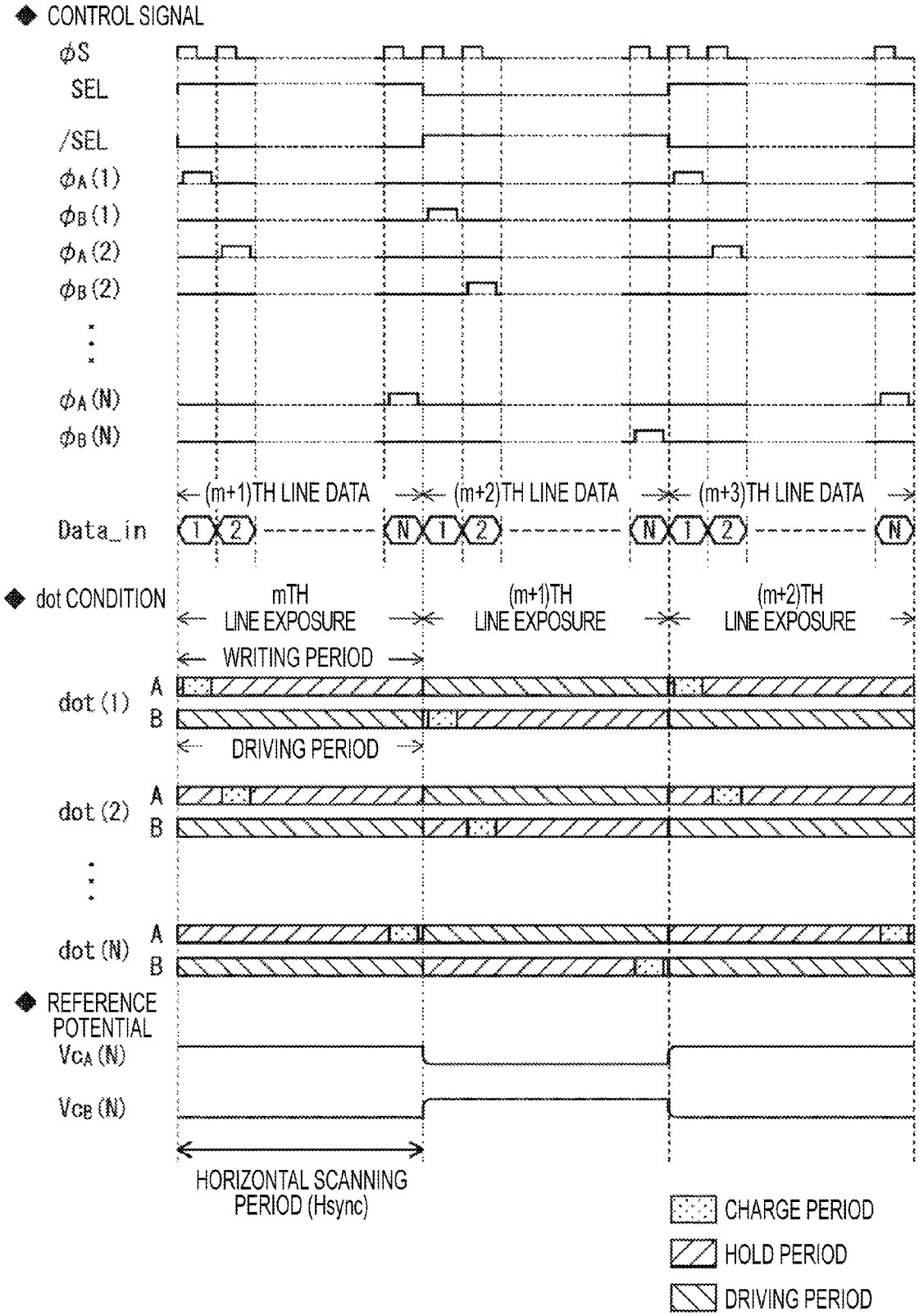
FIG. 7 is a timing chart showing an example of exposing operation performed for one light emission block.

FIG. 7 is a timing chart showing an example of exposing operation executed by the one light emission block. The light emission block exposes the outer circumferential surface of the photosensitive drum 121 line by line. FIG. 7 shows exposing operation executed from the mth line to the (m+2)th line.

As illustrated in FIG. 7, the ϕSH signal repeats both an H state and an L state 100 times to sequentially select the 100 OLEDs 405 constituting the one light emission block during one horizontal scanning period (Hsync).

The SEL signal holds either an H state and an L state during one horizontal scanning period to control on and off of the selector switch 604B of the B system. In the H state of the SEL signal, the selector switch 604B is turned on, and driving current is supplied from the driving circuit 404B of the B system to the OLED 405. On the other hand, in the L state of the SEL signal, the selector switch 604B is turned off, in which condition no driving current is supplied from the B system.

The /SEL signal is an inverse signal of the SEL signal, and controls on and off of the selector switch 604A of the A system. In an H state of the /SEL signal, the selector switch 604A is turned on, and driving current is supplied from the driving circuit 404A to the OLED 405. On the other hand, in an L state of the /SEL signal, the selector switch 604A is turned off, in which condition no driving current is supplied from the A system.

A ϕA(n) signal controls the selector switch 601A included in the driving circuit 404A in the A system of the nth (n=1 through 100) dot driving circuit 403. In an H state of the ϕA(n) signal, the selector switch 601A is turned on, and a luminance signal is written to the capacitor 602A. In an L state of the ϕA(n) signal, the selector switch 601A is turned off, in which condition luminance signal writing to the capacitor 602A is inhibited.

Similarly, a ϕB(n) signal controls the selector switch 601B included in the driving circuit 404B in the B system of the nth (n=1 through 100) dot driving circuit 403. In an H state of the ϕB(n) signal, the selector switch 601B is turned on, and a luminance signal is written to the capacitor 602B. In an L state of the ϕB(n) signal, the selector switch 601B is turned off, in which condition luminance signal writing to the capacitor 602B is inhibited.

During the horizontal scanning period for exposing the mth line, the H-state SEL signal is input, for example. In this case, the A system is designated for the writing period, while the B system is designated for the driving period. Every time the ϕSH signal comes to the H state, a luminance signal is sequentially written to the capacitor 602A of the nth A system and held therein.

Figure 8A:
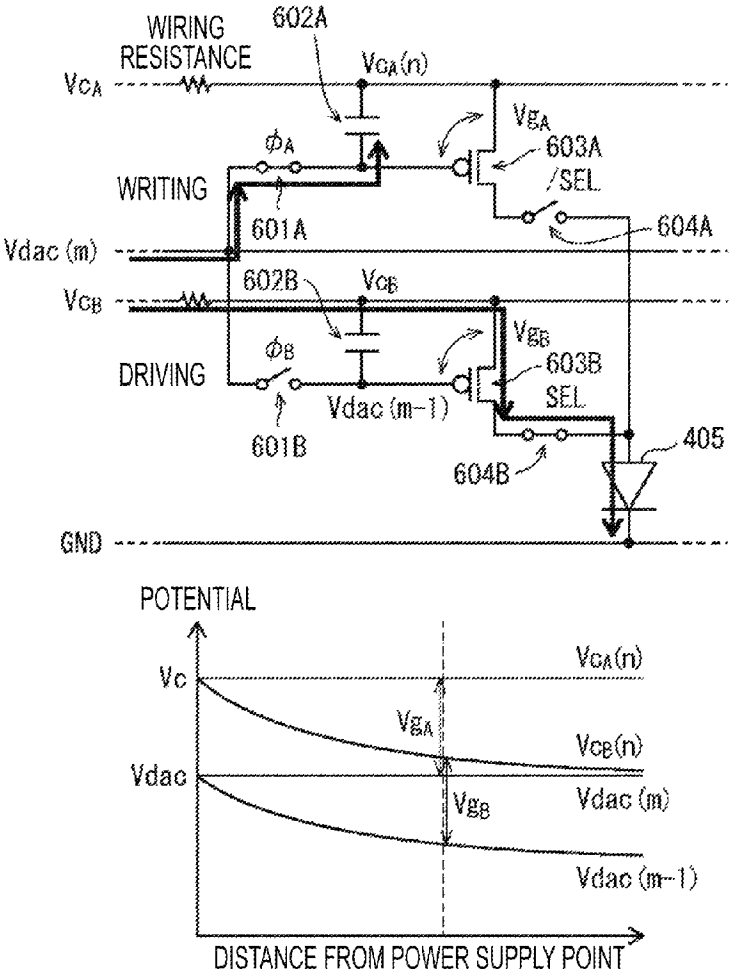
FIGS. 8A and 8B are circuit diagrams showing examples of exposing operation executed by a dot driving circuit 403.

As illustrated in FIG. 8A, the driving circuit 404A of the A system in this case does not supply driving current to the OLED 405. Accordingly, no current flows in the power source line VcA of the A system, wherefore a potential VcA(n) at a junction point between the nth driving circuit 404A and the power source line VcA does not drop. As a result, the potential at the junction point VcA(n) becomes substantially equivalent to a constant voltage Vc, wherefore a potential difference between the constant voltage Vc and a luminance signal Vdac (m) is accurately written to the capacitor 602A.

On the other hand, the driving circuit 404B of the B system supplies, to the OLED 405, driving current corresponding to a potential difference written to the capacitor 602B during the horizontal scanning period for the (m−1)th line in a manner similar to the foregoing method. As a result, current flows in the power source line VcB, wherefore a junction point potential VcB(n) drops.

However, under the condition that the selector switch 601B has been turned off, the potential difference between the terminals of the capacitor 602B is maintained without variation, and applied to the TFT 604B as gate voltage VgB. In this case, the gate voltage VgB of the TFT 603B is not affected by the voltage drop of the junction point potential VcB(n), wherefore non-uniformity of luminance resulting from a voltage drop does not occur.

Figure 8B:
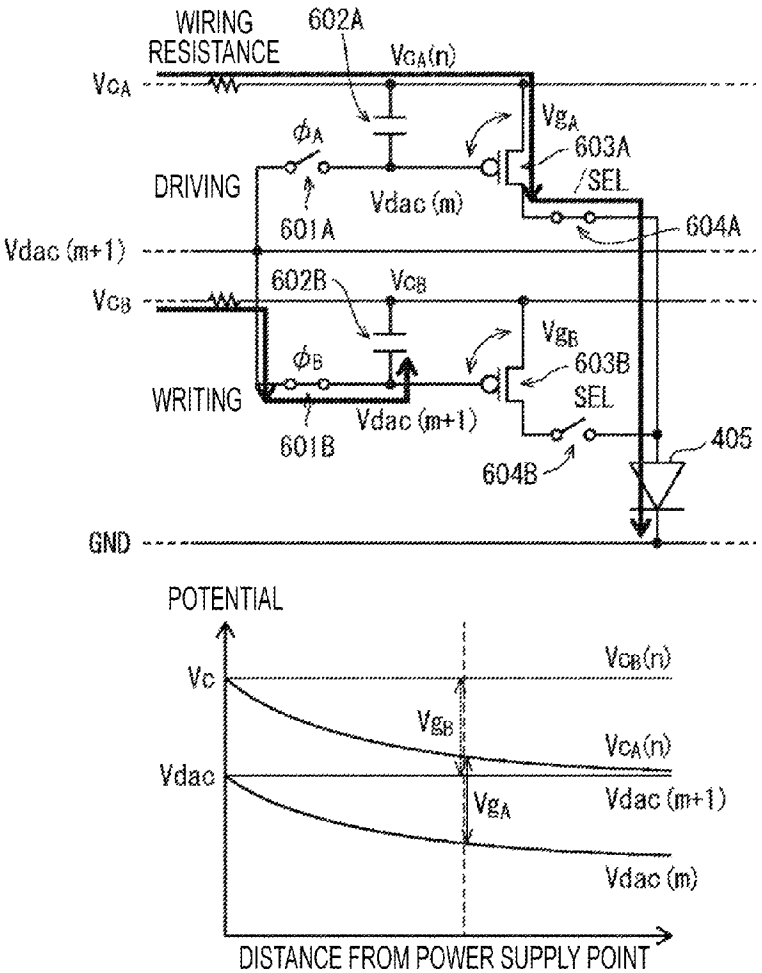

Subsequently, in the horizontal scanning period for exposing the (m+1)th line, the SEL signal comes to the L state. As a result, the writing period of the A system is switched to the driving period, while the driving period of the B system is switched to the writing period. In this case, the driving circuit 404A of the A system supplies driving current to the OLED 405 while not affected by the voltage drop of the junction point potential VcA(n) as illustrated in FIG. 8B. On the other hand, the junction point voltage VcB (n) does not drop in the driving circuit 404B of the B system, wherefore the potential difference between the constant voltage Vc and a luminance signal Vdac(m−1) is accurately written to the capacitor 602B.

During the horizontal scanning periods for exposing the (m+2)th line and further lines, processes similar to the foregoing processes are alternately repeated. After completion of these processes, exposure of an entire printing image ends.

[4] Modified Examples

While the embodiment of the present invention has been described, it is intended, as a matter of course, that the present invention should not be limited to the embodiment described herein. For example, the following modifications may be made.

(1) According to this embodiment, the selector switch 604 is disposed on the circuitry in the range from TFT 603 to the OLED 405. However, needless to say, the present invention is not limited to this example. Instead, the following configuration may be employed.

Figure 9:
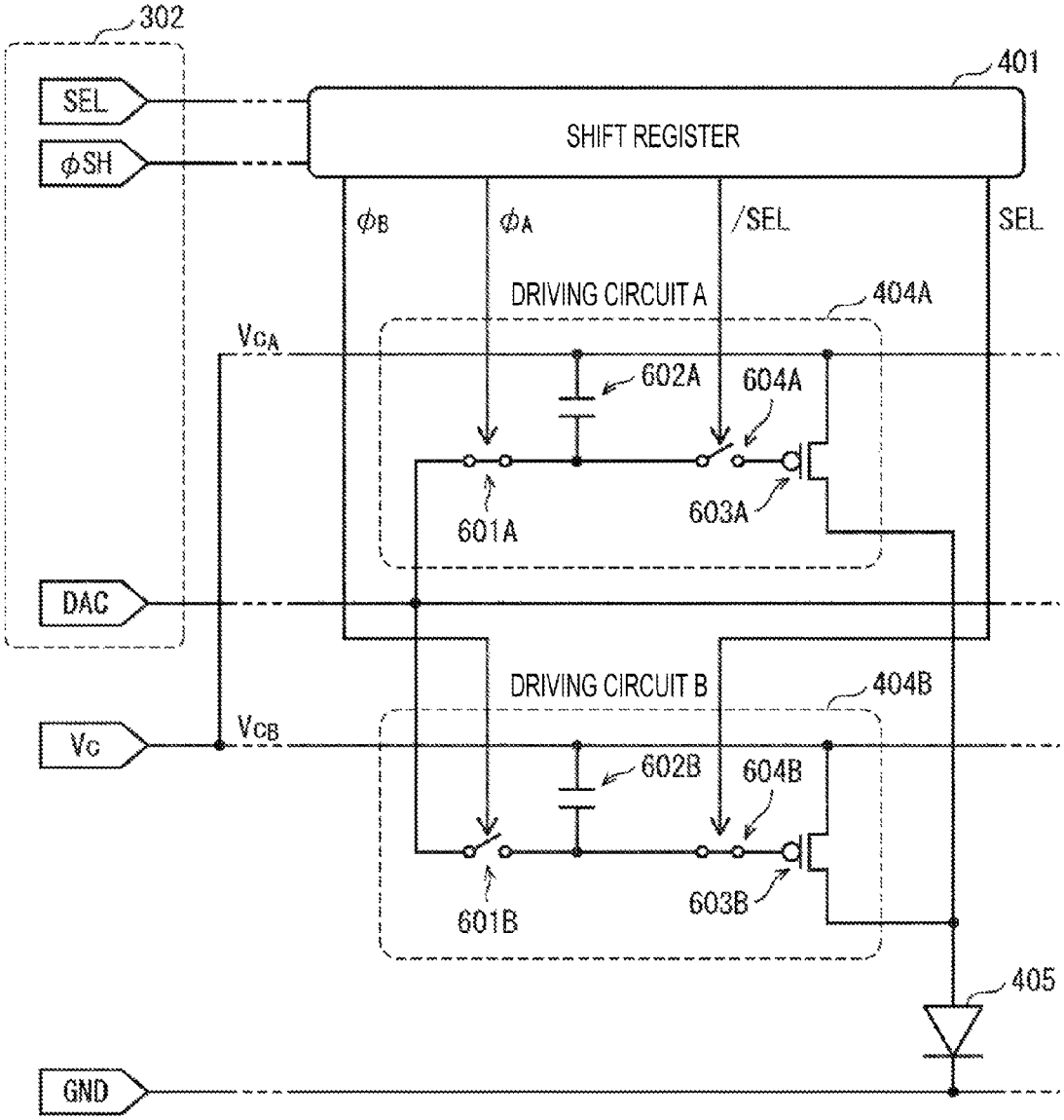
FIG. 9 is a circuit diagram illustrating a main configuration of the dot driving circuit 403 according to a modified example of the present invention.
Figure 10:
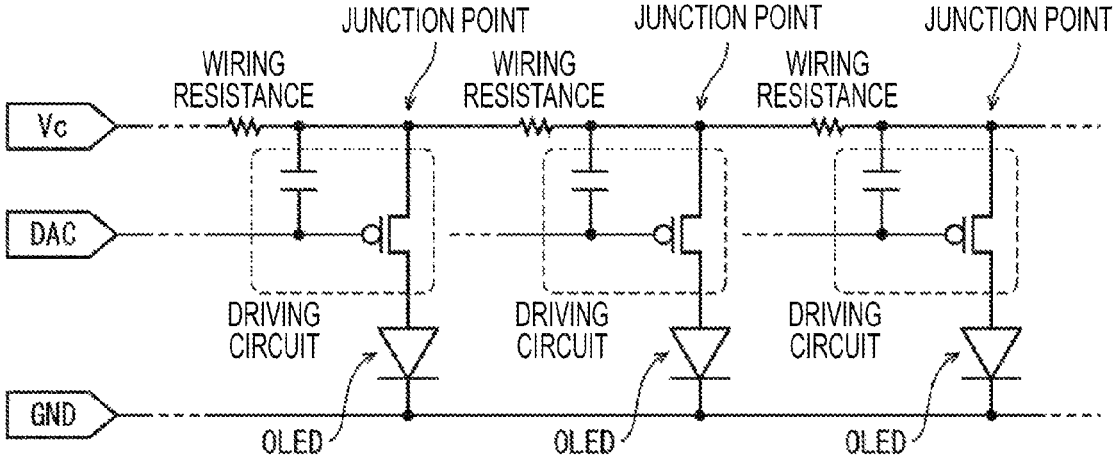
FIG. 10 is a view illustrating a configuration example of an optical writing device according to a conventional technology.
Figure 11A:
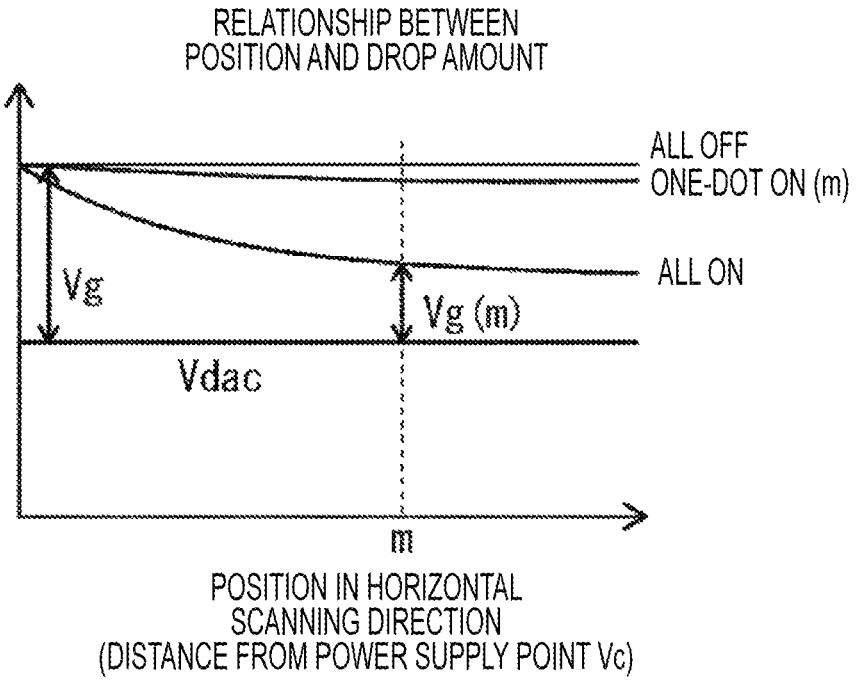
FIGS. 11A and 11B are views illustrating a voltage drop produced in power source wiring.
Figure 11B:
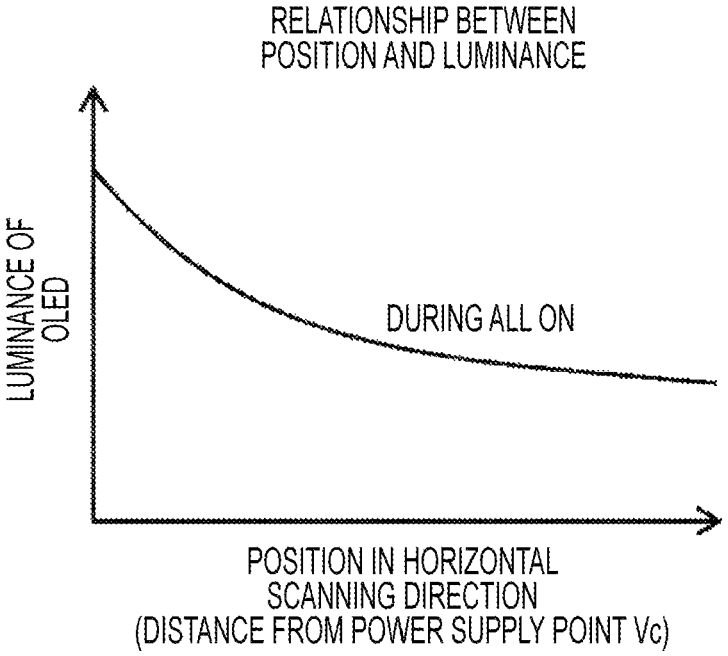

FIG. 9 is a circuit diagram illustrating a main configuration of the driving circuits 404 according to a modified example. As illustrated in FIG. 9, each of the selector switches 604 is disposed on the circuitry in the range from the capacitor 602 to the gate electrode of the TFT 603. According to this configuration, the driving circuits 404 execute similar operation based on control signals similar to the corresponding signals of the foregoing embodiment.

In addition, this configuration decreases loads such as parasitic capacitance and element resistance which may be produced on the drain electrode side of the TFT 603, and thus achieves higher light emission responsiveness. Accordingly, image quality such as contrast and MTF (Modulation Transfer Function) improves.

(2) According to this embodiment, the selector switch 604 is controlled via the shift register 401. However, needless to say, the present invention is not limited to this example. The selector switch 604 may be controlled directly by the source IC 302 or other components positioned outside the dot circuit array 400, for example.

(3) According to this embodiment, the control unit 112 generates the digital luminance signal to allow light emission from the optical writing device 123 based on the printing image data contained in the received job. However, needless to say, the present invention is not limited to this example. Instead, the following configuration may be employed.

The TFT 603 constituting each of the driving circuits 404 has characteristic variations, wherefore driving current may vary even when the same gate voltage is applied. However, when the gate current is adjusted for each of the TFTs 603 based on examinations of characteristic variations of the TFTs 603 carried out beforehand, desired driving current is allowed to be supplied to the respective OLEDs 405.

For this purpose, the control unit 112 stores variation data obtained by the examinations, and allows the luminance signal output unit 310 to adjust the digital luminance signal based on the variation data. More specifically, at the same gate voltage, the control unit 112 outputs a digital luminance signal indicating higher luminance to the TFT 603 which receives smaller driving current, and outputs a digital luminance signal indicating lower luminance to the TFT 603 which receives larger driving current.

This method realizes high image quality regardless of the characteristic variations of the TFTs 603.

(4) According to this embodiment, the example of the tandem color multifunction peripheral has been discussed. However, needless to say, the present invention is not limited to this example. The present invention is applicable to a color apparatus of a type other than the tandem type, or a monochrome apparatus. Moreover, similar advantages are offered when the present invention is applied to a printer, a copy machine equipped with a scanner, or a facsimile machine having a communication function.

An optical writing device and an image forming apparatus according to the present invention are useful devices having a function of an optical writing device utilizing organic LEDs and capable of preventing non-uniformity of light intensity.

According to an embodiment of the present invention, the driving circuit which receives the designation potential does not supply driving current. In this case, a voltage drop does not occur in the power source line connected with the driving circuit. Accordingly, non-uniformity of light emission from the light emitting elements is avoidable, wherefore image quality increases. Moreover, the driving circuit supplying driving current does not receive a new designation potential within the corresponding horizontal scanning period. In this case, light emission duty becomes the maximum, wherefore the life of the light emitting elements increases.

According to an embodiment of the present invention, the first and second power source lines are connected to the constant voltage source at a common power supply point. In this case, a reference potential at which no driving current flows is equalized between the first and second power source lines, when the corresponding driving circuits are connected only to the one side of each of the first and second power source lines with respect to the power supply point. Accordingly, the potential difference between the designation potential and the reference potential is stabilized, wherefore reduction of non-uniformity of luminance and noise is achievable. In addition, cost reduction based on reduction of the number of power sources is also achievable.

According to an embodiment of the present invention, the switching control unit preferably includes selector switches provided for each circuitry in a range from the designation circuit to the holding circuit, and a range from the driving circuit to the light emitting element. According to this configuration, variations of the driving current amount decreases in comparison with a structure which disposed the selector switch for each circuitry in a range from the power source line to the driving circuit. Moreover, manufacture is easier than in a structure which disposes the light emitting element for each circuitry in a range from the driving circuit to the selector switch.

According to an embodiment of the present invention, the switching control unit preferably includes selector switches provided for each circuitry in a range from the designation circuit to the holding circuit, and a range from the holding circuit to the driving circuit. According to this configuration, light emission responsiveness of the light emitting elements improves as a result of decrease in parasitic capacitance. Accordingly, the time required for forming an electrostatic latent image becomes shorter. In addition, manufacture of each circuitry becomes easier.

According to an embodiment of the present invention, when a correcting unit is provided as a unit that corrects the designation potential in accordance with characteristic variations of each of the driving circuits, image quality further improves.

According to an embodiment of the present invention, the light emitting elements are preferably OLEDs. It is further preferable that each of the driving circuits and the selector switches is a thin film transistor.

According to an embodiment of the present invention, an image forming apparatus according to an aspect of the present invention includes the optical writing device according to an aspect of the present invention. According to this configuration, the foregoing advantages are offered.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An optical writing device that exposes a photosensitive body to form an electrostatic latent image line by line for each horizontal scanning period, the optical writing device comprising:

a plurality of current driven light emitting elements arranged in lines;

first and second power source lines extending along the plurality of light emitting elements, and connected with a constant voltage source;

a designation circuit that outputs a designation potential designating a light emission amount for each of the light emitting elements;

a respective first driving circuit provided for each one of the light emitting elements, each of the respective first driving circuits including a first holding circuit that receives and holds the designation potential output from the designation circuit, and each of the respective first driving circuits being connected with the first power source line to supply driving current to the corresponding light emitting element in accordance with a potential difference between a potential at a junction point with the first power source line and the designation potential held by the first holding circuit;

a respective second driving circuit provided for each one of the light emitting elements, each of the respective second driving circuits including a second holding circuit that receives and holds the designation potential output from the designation circuit, and each of the respective second driving circuits being connected with the second power source line to supply driving current to the corresponding light emitting element in accordance with a potential difference between a potential at a junction point with the second power source line and the designation potential held by the second holding circuit; and a switching control unit that controls the respective first and second driving circuits provided for a respective one of the light emitting elements corresponding to the respective first and second driving circuits so as to alternately switch respective states of the respective first and second driving circuits of the respective one light emitting element between a first state where one of the respective first and second driving circuits receives the designation potential while the other driving circuit supplies the driving current, and a second state where the other driving circuit receives the designation potential while the one driving circuit supplies the driving current, for each of the horizontal scanning periods.

2. The optical writing device according to claim 1, wherein the first and second power source lines are connected to the constant voltage source at a common power supply point, and the respective first and second driving circuits are connected to only one side of each of the first and second power source lines with respect to the power supply point.

3. The optical writing device according to claim 1, wherein the switching control unit includes selector switches provided for each circuitry in a range from the designation circuit to the holding circuit, and a range from the driving circuit to the light emitting element.

4. The optical writing device according to claim 1, wherein the switching control unit includes selector switches provided for each circuitry in a range from the designation circuit to the holding circuit, and a range from the holding circuit to the driving circuit.

5. The optical writing device according to claim 1, further comprising a correcting unit that corrects the designation potential in accordance with characteristic variations of each of the first and second driving circuits.

6. The optical writing device according to claim 1, wherein the light emitting elements are OLEDs.

7. The optical writing device according to claim 1, wherein each of the first and second driving circuits and the selector switches is a thin film transistor.

8. An image forming apparatus, comprising:

a photosensitive body; and an optical writing device that exposes the photosensitive body and forms an electrostatic latent image line by line for each horizontal scanning period, wherein the optical writing device includes a plurality of current driven light emitting elements arranged in lines, first and second power source lines extending along a plurality of light emitting elements, and connected with a constant voltage source, a designation circuit that outputs a designation potential designating a light emission amount for each of the light emitting elements, a respective first driving circuit provided for each one of the light emitting elements, each of the respective first driving circuits including a first holding circuit that receives and holds the designation potential output from the designation circuit, and each of the respective first driving circuits being connected with the first power source line to supply driving current to the corresponding light emitting element in accordance with a potential difference between a potential at a junction point with the first power source line and the designation potential held by the first holding circuit, a respective second driving circuit provided for each one of the light emitting elements, each of the respective second driving circuits including a second holding circuit that receives and holds the designation potential output from the designation circuit, and each of the respective second driving circuits being connected with the second power source line to supply driving current to the corresponding light emitting element in accordance with a potential difference between a potential at a junction point with the second power source line and the designation potential held by the second holding circuit, and a switching control unit that controls the respective first and second driving circuits provided for a respective one of the light emitting elements corresponding to the respective first and second driving circuits so as to alternately switch respective states of the respective first and second driving circuits of the respective one light emitting element between a first state where one of the respective first and second driving circuits receives the designation potential while the other driving circuit supplies the driving current, and a second state where the other driving circuit receives the designation potential while the one driving circuit supplies the driving current, for each of the horizontal scanning periods.

9. The image forming apparatus according to claim 8, wherein the first and second power source lines are connected to the constant voltage source at a common power supply point, and the respective first and second driving circuits are connected to only one side of each of the first and second power source lines with respect to the power supply point.

10. The image forming apparatus according to claim 8, wherein the switching control unit includes selector switches provided for each circuitry in a range from the designation circuit to the holding circuit, and a range from the driving circuit to the light emitting element.

11. The image forming apparatus according to claim 8, wherein the switching control unit includes selector switches provided for each circuitry in a range from the designation circuit to the holding circuit, and a range from the holding circuit to the driving circuit.

12. The image forming apparatus according to claim 8, further comprising a correcting unit that corrects the designation potential in accordance with characteristic variations of each of the respective first and second driving circuits.

13. The image forming apparatus according to claim 8, wherein the light emitting elements are OLEDs.

14. The image forming apparatus according to claim 8, wherein each of the respective first and second driving circuits and the selector switches is a thin film transistor.

15. The optical writing device according to claim 1, wherein the same light emitting element emits light during both the first state and the second state.

16. The image forming apparatus according to claim 8, wherein the same light emitting element emits light during both the first state and the second state.

* * * * *